United States Patent [19]

Randa

[11] Patent Number: 4,653,239

[45] Date of Patent: Mar. 31, 1987

[54] PRE-ENGINEERED BUILDING AND METHOD OF ASSEMBLING SAME

[76] Inventor: Wallace H. Randa, 4527 Weir St., Omaha, Nebr. 68117

[21] Appl. No.: 599,645

[22] Filed: Apr. 12, 1984

[51] Int. Cl.[4] ..... E04D 3/36; E02H 27/00; E04F 17/00; E04B 1/38

[52] U.S. Cl. ..... 52/90; 52/92; 52/94; 52/221; 52/282; 52/283; 52/293; 52/299

[58] Field of Search ..... 52/292, 91, 293, 573, 52/90, 92, 463, 467, 468, 221, 220, 282, 283, 299, 94

[56] References Cited

U.S. PATENT DOCUMENTS

| | | | |
|---|---|---|---|
| 2,071,666 | 2/1937 | Sylvan . | |
| 2,160,225 | 5/1939 | Newman | 52/463 |
| 2,443,548 | 6/1948 | Wilson | 52/217 |
| 2,621,378 | 12/1952 | Wilson . | |
| 2,630,604 | 3/1953 | Marsh | 52/573 |
| 2,739,677 | 3/1956 | Grevlich . | |
| 2,836,266 | 5/1958 | Lesser . | |
| 2,838,592 | 6/1958 | Feketics | 52/463 |
| 2,862,254 | 12/1958 | Meek . | |
| 2,954,419 | 9/1960 | Bolef . | |
| 3,051,277 | 8/1962 | Day, Jr. . | |
| 3,070,186 | 12/1962 | Meek . | |
| 3,070,196 | 12/1962 | Switzgable, Jr. . | |
| 3,203,147 | 8/1965 | Penley . | |
| 3,236,014 | 2/1966 | Edgar . | |
| 3,255,563 | 6/1966 | Saver . | |
| 3,282,003 | 11/1966 | Swift, Jr. . | |
| 3,352,073 | 11/1967 | Hipple . | |
| 3,353,314 | 11/1967 | Melcher . | |
| 3,389,519 | 6/1968 | Williams . | |
| 3,392,497 | 7/1968 | Cushman . | |
| 3,453,795 | 7/1969 | Heirich . | |
| 3,459,875 | 8/1969 | Fork . | |
| 3,462,897 | 8/1969 | Weinrott . | |
| 3,529,389 | 9/1970 | Wilkins . | |
| 3,561,182 | 2/1971 | Madl, Jr. . | |
| 3,591,993 | 7/1971 | Reeves . | |
| 3,707,165 | 12/1972 | Stahl . | |
| 3,952,471 | 4/1976 | Mooney . | |
| 3,988,867 | 11/1976 | Vaananen . | |
| 4,231,199 | 11/1980 | Gomez . | |
| 4,255,611 | 3/1981 | Propst . | |
| 4,372,087 | 2/1983 | Kump . | |
| 4,378,664 | 5/1983 | Andaya . | |
| 4,394,809 | 7/1983 | Sherwood et al. . | |
| 4,455,801 | 6/1984 | Merritt | 52/463 |

FOREIGN PATENT DOCUMENTS

| | | | |
|---|---|---|---|
| 231862 | 7/1959 | Australia | 52/466 |
| 1209720 | 3/1960 | France | 52/463 |

*Primary Examiner*—John E. Murtagh
*Attorney, Agent, or Firm*—E. R. Newman

[57] ABSTRACT

A factory manufactured building assembled on site, comprising a load bearing structural frame with exterior wall units, floor units, and roof units supported thereon. The various units are assembled on the structural frame using a method that allows simultaneous assembly, or assembly in any desired order. The wall units are installed using devices which expand into the structural framework. The roof units are installed using devices which clamp onto the structural framework. The floor units rest on ledges formed in the framework and are secured thereto with clamp devices. All electrical, plumbing and mechanical systems are installed in the various floor, wall and roof units at the factory, and are connected together at the site.

11 Claims, 14 Drawing Figures

PRE-ENGINEERED BUILDING AND METHOD OF ASSEMBLING SAME

TECHNICAL FIELD

This invention relates to a pre-engineered building and a method of assembling the same.

BACKGROUND ART

The only types of housing construction I know of in which a complete house is factory-built are mobile homes and houses that are prefabricated in halves at the factory and transported to the site. This type of construction is limited to one story and is still conventional in the sense that one portion of the building still depends on other portions for support. Also, certain building portions must be installed before others can be.

Although, I find in the prior art building components such as precast concrete, prefabricated wall panels and structural grid system of different varieties, I find no system of construction in which all components for an entire building may be simultaneously manufactured at the factory and then simultaneously erected at the building site. I find no system in which concrete forms are factory produced so as to use the structural framework for automatic leveling, and plumbing as the forms are attached to the framework. In addition, in the prior art it is generally necessary to brace the forms.

One problem unsolved in the prior art is the necessity for manufacturing and erecting a house in a generally specific and inflexible order. For instance, in typical home construction, floors must be installed before bearing walls, bearing walls before roof, rough plumbing and electrical work must be completed before wall board is applied. As all phases of construction depend on one another, scheduling and logistics represent a major cost.

Although the prior art discloses versions of plumbing walls and electrical raceways, I am not aware of any which require only primary connections between wall units, floor units and plumbing fixtures, and, otherwise are complete from the point of utility entrance. As a consequence, skilled labor in the prior art must be heavily involved.

SUMMARY OF THE INVENTION

In order to remedy the disadvantages of the prior arts, I provide for a novel system of manufacturing and erecting a building in which a framework carries all of the structural loads of the building. Non-load bearing exterior and interior walls, floor, ceiling and roof units are simultaneously manufactured in a factory, delivered to the building site, and simultaneously erected. The objectives of this invention are as follows:

1. To provide a new and improved system of manufacturing and erecting houses, apartments and buildings.

2. To provide a new and improved system of constructing a building whereby a structural framework is provided which carries all the structural loads of the building.

3. To provide a new and improved system of constructing a building using independent primary building units which carry no structural loads and can be attached to structural framework in any desired order.

4. To provide a new and improved system of constructing a building whereby any building units may be quickly and easily removed from the framework if damaged or, if it is desired, to disassemble the building.

5. To provide a new and improved system of building construction which utilizes factory manufactured cooperating building units such that all mechanical systems require very little time and labor to factory manufacture and hook up at building site.

6. To provide a new and improved system of simultaneously manufacturing a complete house, apartment or building comprised of structural framework, exterior and interior walls, floor, ceiling, plumbing and roof units, carried out in a manner that would lend itself to the adoption of production line techniques, characterized by using the concept of tooling in order that unskilled labor is utilized to produce a building in a period of time and for costs heretofore unknown.

7. To provide a new and improved system of simultaneously erecting components for a house, apartment or building with components comprised of structural framework, exterior and interior walls, floor, ceiling, plumbing and roof units coordinated and pre-assembled in the factory, shipped to the building site, erected by unskilled labor in a period of time and for costs heretofore unknown.

8. To provide novel securement apparatuses and methods which provide for quick and easy installation of all building units and for each unit being capable of independent replacement without disturbing other units.

The invention provides a new and improved system of preengineering a complete house, apartment or building that can be simultaneously manufactured and erected. The building is comprised of load bearing structural frame, non-load bearing exterior and interior wall units, floor, plumbing, ceiling and roof units. Substantially all windows, doors, openings and mechanical appurtenances therein are completed and coordinated simultaneously in a factory and then erected simultaneously at the building site. The load bearing structural frame which carries all structural loads of the building is sized and coordinated at the factory and is comprised of columns, girders, support rods and end angles which are simultaneously manufactured for fast erection at the building site. A load bearing structural frame in grid pattern is thus formed.

These and other objects, advantages and novel features of my invention will become apparent from the following detailed description of the invention when considered in conjunction with the accompanying drawings.

BRIEF DESCRIPTION OF THE DRAWINGS

FIG. 4-A is a perspective view of a typical interior plumbing wall unit ready for field installation.

DESCRIPTION OF THE PREFERRED EMBODIMENT

Figure 1:
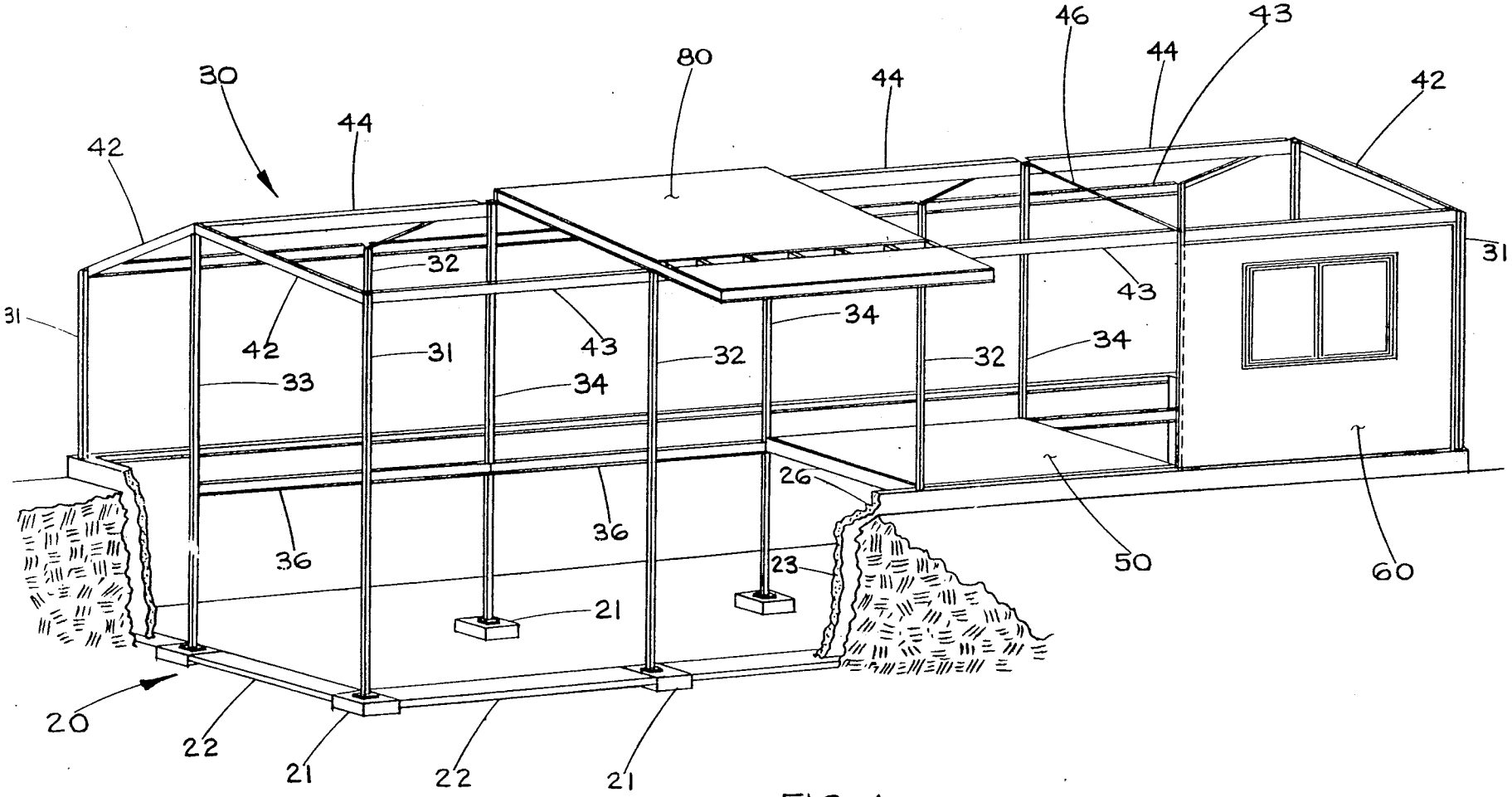
FIG. 1 is a perspective view of a building foundation and structural framework as prepared in the field with one floor unit, one exterior wall unit and one roof unit installed thereupon by the new and improved system of the present invention.

Referring now to the drawings in which identical or corresponding parts are indicated by like reference numerals throughout the several views and more particularly to FIG. 1, the poured concrete portions, indicated generally at (20), and the structural framework, indicated generally at (30), of my pre-engineered building (not included in the drawings because in completed form its appearance is that of a conventional house) are shown. Although it is possible that my pre-engineered buildings be "T" Shaped, "L" Shaped, more than one story, or numerous other configurations comprising square or rectangular elements, for simplicity purposes the embodiment to be described herein is comprised of two rows of four bays, each substantially square, resulting in a rectangular configuration of one story height, with basement.

As can best be seen in FIG. 1, framework (30) includes four corner columns (31), three longitudinal perimeter columns (32) spaced at regular intervals between the corner columns (31) on each side,one lateral perimeter column (33) located midway between the corner columns (31) on each end, and three interior columns (34) aligned in grid fashion with the lateral and longitudinal perimeter columns (32) and (33). In the preferred embodiment, all columns (31), (32), (33), and (34) are box columns, hollow and rectangular in cross-section, but could be of other configurations. The lateral perimeter columns (33) as well as the interior columns (34) are slightly longer than the other columns, in order to provide a slope roof. It should also be noted that my building and assembly method could be applied in concept, to a one-bay building.

Note also that all columns run from the top of their column footing (21) (approximately basement floor level) to the top of the first story exterior wall (in the case of interior columns (34) and lateral perimeter columns (33), to the underside of the peak of the roof). Thus, the lower portion of the corner columns (31) and perimeter columns (32) and (33) provide a convenient anchor point for specialized reusable concrete forms (90) (see FIG. 13) for the basement wall (23), without requiring more than one set of columns from basement level to roof level. These special forms (90) for the concrete basement walls (or ground level slab where no basement is used) are sized and coordinated at the factory. They have bolt hole (91) and bolts (92) coordinated to threaded sleeves (31*a*) on the perimeter columns so that installation at the building site is accomplished very quickly with no measuring or leveling required. The forms are automatically in plumb condition. Columns can also extend vertically to heights of more than one story. In such cases the center columns extend to a height terminating a sufficient distance above said perimeter columns to provide a slope roof.

Figure 13:
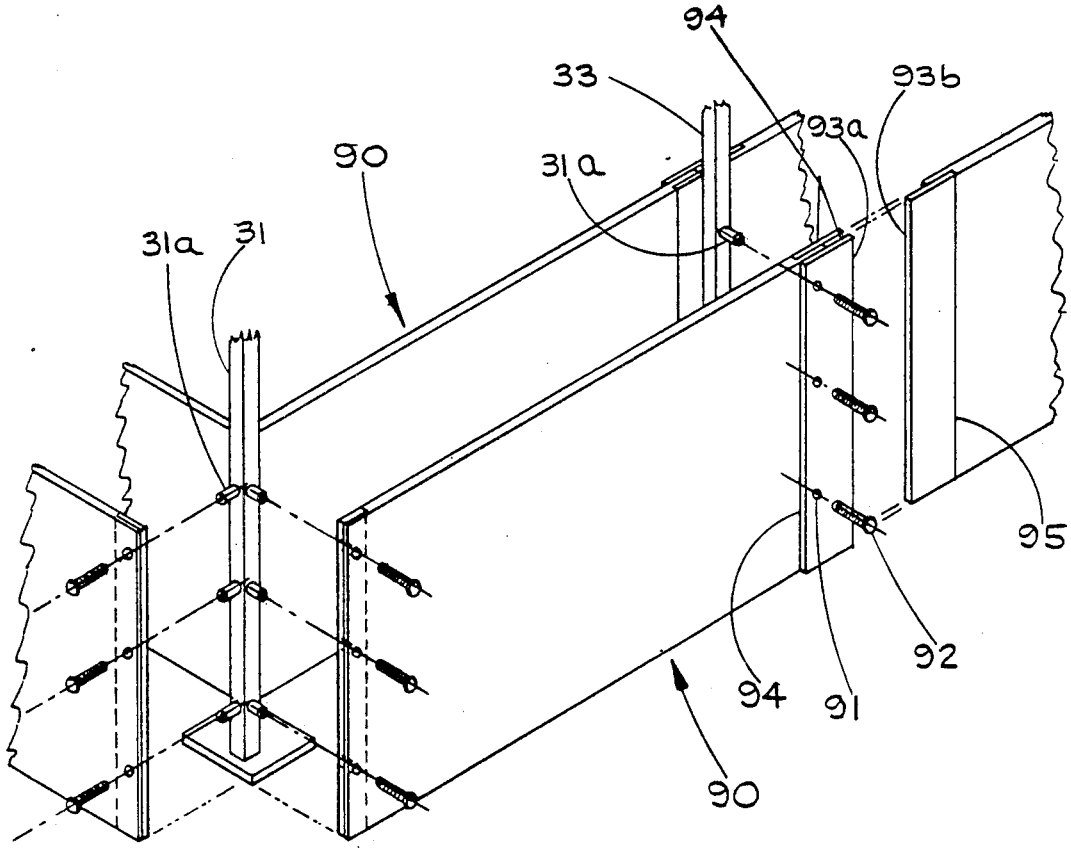
FIG. 13 is an enlarged partial view showing special concrete forms attaching to perimeter columns.

A typical reusable concrete form (90), shown in FIG. 13 is pre-assembled in a factory with all necessary bolt holes (91) and bolts (92) coordinated to internal threaded sleeves (31*a*) affixed to perimeter columns (31), (32), and (33). Sleeves (31*a*) have a length that determine thickness of basement walls (23) and interior diameter approximately equal to that of hole (91).

Referring again to FIG. 13, one vertical edge of special forms (90), designated as the receiving edge (93*a*), is comprised of two plates (94) and so spaced as to leave an opening in between. The opposite vertical edge of form (90), designated as protruding edge (93*b*), is comprised of one plate (95) so positioned that at installation plate (95) inserts between plates (94) and is locked into position.

In general, the shape, size, and type of column footings (21) is conventional and can vary in accordance with need and engineering preference. The same is true for wall footings (22) with respect to poured concrete basement wall (23). Special reusable factory manufactured forms for the concrete footings are sized and coordinated at the factory and have leveling rods attached. Locating points for anchor bolt templates are installed at building site and require no measuring or squaring. The invention will work with either footings located at ground level and penetrating to frost line, located within an excavated basement area, or with columns affixed directly to a slab on ground level. In this embodiment the column and wall footings are one.

Figure 6:
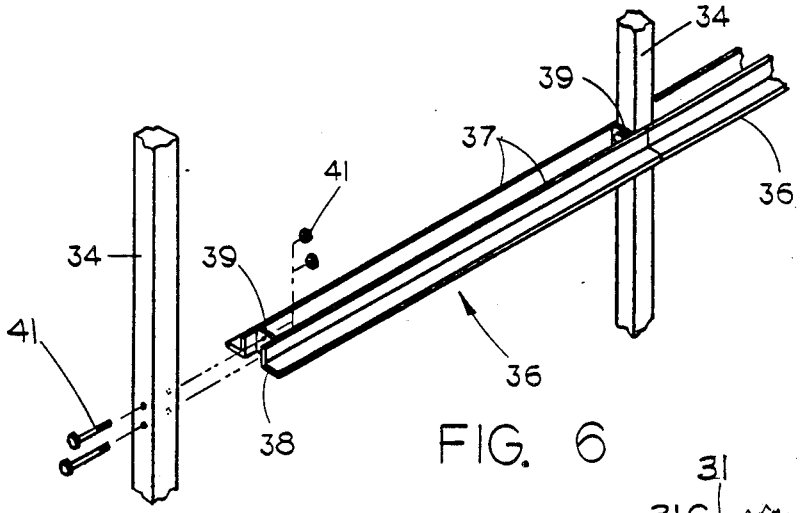
FIG. 6 is a perspective view of a special girder used in the building.

Still referring to FIG. 1, special girders (36) run between lateral perimeter columns (33) and interior columns (34) as well as between adjacent interior columns (34) at approximately ground level. Special girders (36) (see FIG. 6) are comprised of back to back angles (37) with the horizontal leg (38) facing outwardly and two cross pieces (39) inset from either end. The size and position of cross pieces (39) are such that columns (33) and (34) are automatically spaced into correct position and ends of adjoining special girders (36) will fit snugly around no more than one-half of a lateral perimeter column (33) or an interior column (34) and permit the securement thereto of an end of a special girder (36) to either side of said columns by nut and bolt sets (41) within pre-drilled holes.

All of the other members of the structural framework (30) run between the tops of the various columns (see FIG. 1) and include end angles (42) which run between each corner column (31) and lateral perimeter columns (33), longitudinal girders (43) which run between each corner column (31) and longitudinal perimeter column (32) as well as between each adjoining perimeter column (32), ridge girders (44) which run between each lateral perimeter column (33) and the adjacent interior column (34), as well as between each pair of interior columns (34), and support rods (46) which run between perimeter columns (32) and interior columns (34). All elements of the framework are factory sized and have threaded studs and appropriate tabs, where needed, with threaded studs appropriately located to connect end plates, etc. on the girders and angles in precisely the correct position. Columns have conventional base plates to cooperate with anchor bolts, and carry a tapped hole (31*b*) (see FIG. 7) for set screw to level column vertically if required. Longitudinal girders (43) and ridge girders (44) are preferably of a "channel" cross-section, but may be otherwise.

Figure 10:
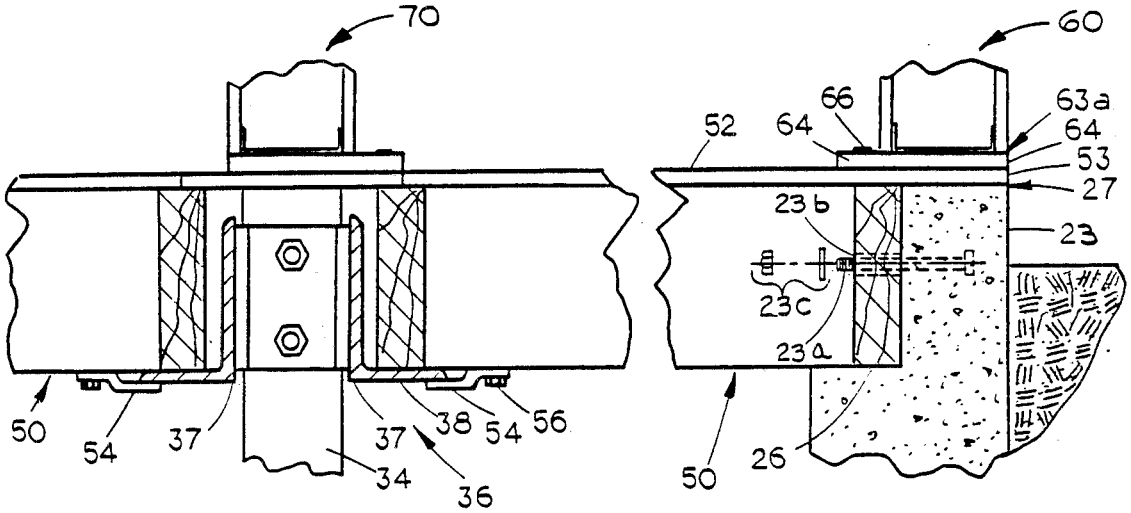
FIG. 10 is an enlarged partial sectional view showing the juncture of one end of a floor unit with the basement wall and an exterior wall unit, and the other end of a floor unit with an interior column, another floor unit and an interior wall unit.

Referring to FIGS. 1 and 10, concrete basement wall (23) has a horizontal ledge (26) along its interior face a short distance below its horizontal top (27). The ledge (26) is at the same level as the top of leg (38) of angle (37) of special girder (36). Each factory built floor unit, designated generally at (50), is supported between ledge (26) and the ledge formed by leg (38). Bolts (23*a*) are embedded in vertical face between horizontal ledge (26) and horizontal top (27) with their threaded ends facing inward to center of the basement One end of each floor unit (50) is secured in position atop ledge (26) using anchor bolts (23*a*) in an obvious manner. Floor units (50) will be described in more detail hereinafter.

Figure 12:
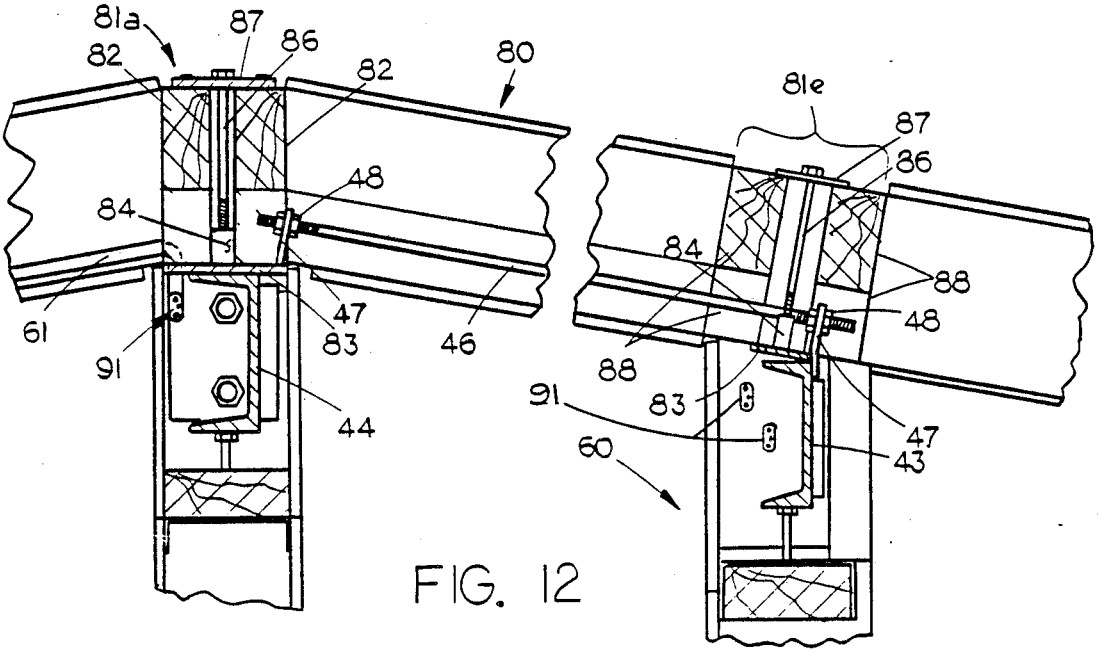
FIG. 12 is an enlarged partial sectional view showing the juncture of one end of a roof unit with a ridge girder and another roof unit, and the other end of a roof unit with a perimeter and exterior wall unit.

Referring now to FIGS. 1 and 12, support rods (46) are threaded on each end, and project through an aperture in tabs (47*a*) and (47*b*) which project upwardly from perimeter columns (32) and interior columns (34), respectively. The rods (46) have two nuts (48) on each end, which are tightened against each side of both tabs (47*a*) and (47*b*) to hold the rod (46) in place. The rods (46) thus may be used to plumb the columns (32) and (34) in the lateral direction by adjusting nuts (48) on the rods (46) to shorten or lengthen the distance between the columns (32) and (34). As will be seen when the installation of roof units, designated generally at (80), are described, support rods (46) are primarily for lateral support and to plumb the columns.

Once the columns are plumbed using rods (46), roof units, designated generally at (80) and to be described in more detail below, are clamped upon ridge (44) and longitudinal girder (43). Roof units (80) are clamped to the ridge girders (44) by the use of a coupling device consisting of a plate (83), affixed to the upper surface of ridge girders (44), interiorly threaded sleeves (84) affixed with longitudinal axes perpendicular to the plate (83) and spaced therealong at convenient intervals, elongated bolts (86) threaded on one end to fit within said sleeves (84), and strap (87) with spaced apertures axial to each sleeve (84). A projecting edge element (82) of each roof unit (80) rests upon the plate (83) and extends as far as the near side of sleeve (84), thus leaving a space between itself and the adjacent edge element (82) of the side opposite units (80). The elongated bolts (86) pass through strap (87) and this space. Once positioned, strap (87) is clamped on top of the adjacent edges of the roof units (80) by tightening bolts (86) within sleeves (84). A similar type of coupling device is used to clamp the framework of roof unit (80) to longitudinal perimeter girders (43), and will be described in more detail below.

Referring again to FIG. 1, the first step in assembling the pre-engineered buildings is to excavate for a basement, and pour column footings (21) and basement wall footings (22). Special forms and anchor bolt templates (not shown) are used to position column anchor bolts on the footings with their pouring.

The structural framework (30) is erected upon the footings (21) and (22) by first positioning a corner column (31) on the present anchor bolts. A lateral perimeter column (33) is then positioned on the center column footing (21) over its preset anchor bolts. The second column (33) is plumbed and spaced to correct position and held in place by a special spacer bar (49), shown in FIG. 7.

Figure 7:
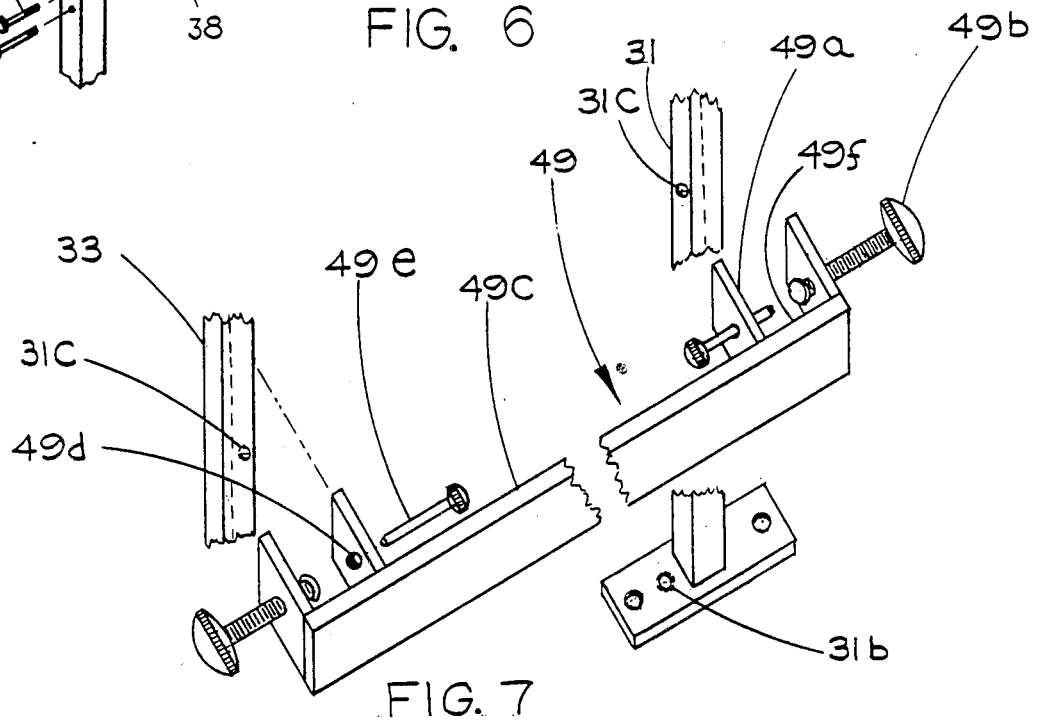
FIG. 7 is a perspective view of a spacer bar, used in constructing the building.

Referring now to FIG. 7, the special spacer bar (49) has a locating face (49*a*) and screw clamp (49*b*) on opposing ends of a telescoping frame (49*c*) (not shown). Each locating face (49*a*) has a close tolerance hole (49*d*) and locating pin (49*e*). The faces (49*a*) are set to a predetermined distance and used to space corner column (31) and lateral perimeter column (33). Close tolerance holes (49*d*) and locating pins (49*e*) are used to vertically level columns (31) and (33) and screw clamps (49*b*) clamp columns (31) and (33) against locating face (49*a*), thus automatically plumbing columns.

Once corner column (31) and perimeter column (33) are in position on pre-set anchor bolts, each end of a spacer bar (49) slides onto columns with column stopping against back locating face (49*f*). Locating pin (49*e*) on perimeter column (33) end is inserted through close tolerance hole (49*d*) into tooling hole (31*c*). Finally, screw clamp (49*b*) clamps perimeter column (33) against locating face (49*a*).

On opposite end, corner column (31) is raised vertically by set screw (31*b*), located on base plate of column, until locating pin (49*e*) goes through locating face (49*a*) and into tooling hole (31*a*). Screw clamp (49*b*) clamps corner column (31) against locating face (49*a*) thus automatically spacing, leveling and plumbing columns (31) and (33).

Interior column (34) and longitudinal perimeter column (32) are plumbed and spaced into position from columns (31) and (33) by special girder (36), ridge girder (44) and longitudinal perimeter girder (43) which have attaching surfaces with coordinated holes to match threaded studs welded on columns (31), (32), (33), and (34). Once girders (36), (43), and (44) are fastened to said columns, a support rod (46) is installed between columns (34) and (32), as described above and an end angle (42) is installed by being bolted at either end to tabs welded to plates (83). Succeeding elements of frame (30) are then installed in the various manners set forth above until all columns (31), (33), (34), girders (43), (44), (36), angles (42), and support rods (46) are in place.

Once the structural framework (30) is in place, basement walls (23) are poured using special forms (90) (see FIG. 13) which utilize the spacings and which may be attached directly to the columns of the framework (30), and adjusted to various widths depending upon the thickness of the wall desired.

Figure 2:
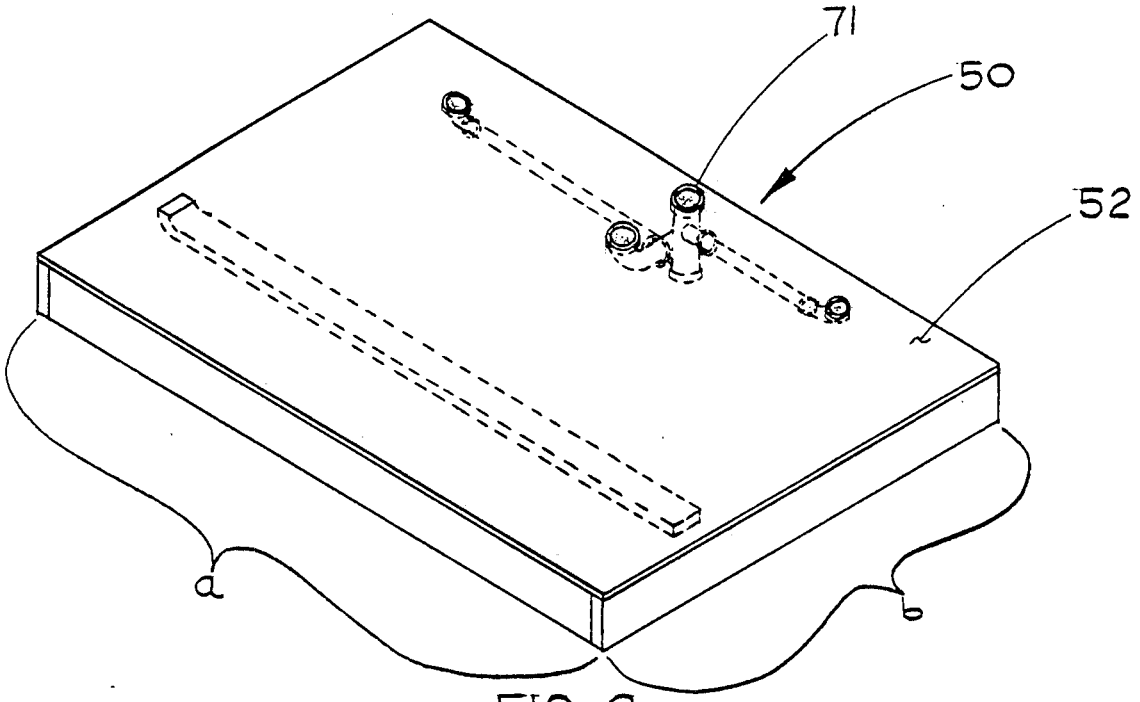
FIG. 2 is a perspective view of a typical floor unit ready for field installation.

Referring now to FIGS. 1 and 2, the floor units (50) are pre-assembled in a factory and are of a length (a) adapted to fit between a longitudinal basement wall (23) and special girders (36) along the center of the basement. The width (b) of the unit may be of any uniform dimension convenient for the design of the building. Plumbing, ductwork, and electrical wiring are all installed within the floor unit (50) at the factory, according to the predetermined design.

Each floor unit (50) is installed by first hoisting the unit (50) into the predetermined location of the floor plan. As can be seen in FIG. 10, the edge of the unit (50) abutting the basement wall (23), fits upon ledge (26) so that the sub-floor (52) is level with filler piece (53) on top of the wall (23). It is held in place by a plurality of anchor bolts (23*a*) which were embedded by template in basement wall (23) at pouring. Oversized holes (23*b*) fit over anchor bolts (23*a*) as floor (52) is slipped into place. Nut and washer sets (23*c*) are then installed. The opposite edge of the floor unit (50) rests upon leg (38) of the special girder (36), and is held in place by tightening a plurality of pivot clamps (54) against the leg (38) via a bolt (56). The pivot clamp (54) and bolt (56) combinations are attached on the joists of each floor unit (50) at the factory, and are utilized along this edge of the floor unit (50) at predetermined spacings based upon the restraining strength desired. Succeeding floor units (50) are then installed in the same fashion.

The installation of the exterior wall units, designated generally at (60), interior wall units, designated generally at (70)and (70*a*), and roof units (80) may be accomplished simultaneously, or in any order, by using this new and improved system of erecting a building. It should also be noted that it is possible to install exterior wall units (60) and roof units (80) before any floor units (50) are installed. The description of each unit and its installation should therefore be considered as independent from the other units, such that any sequence of construction may be used under the system.

Figure 3:
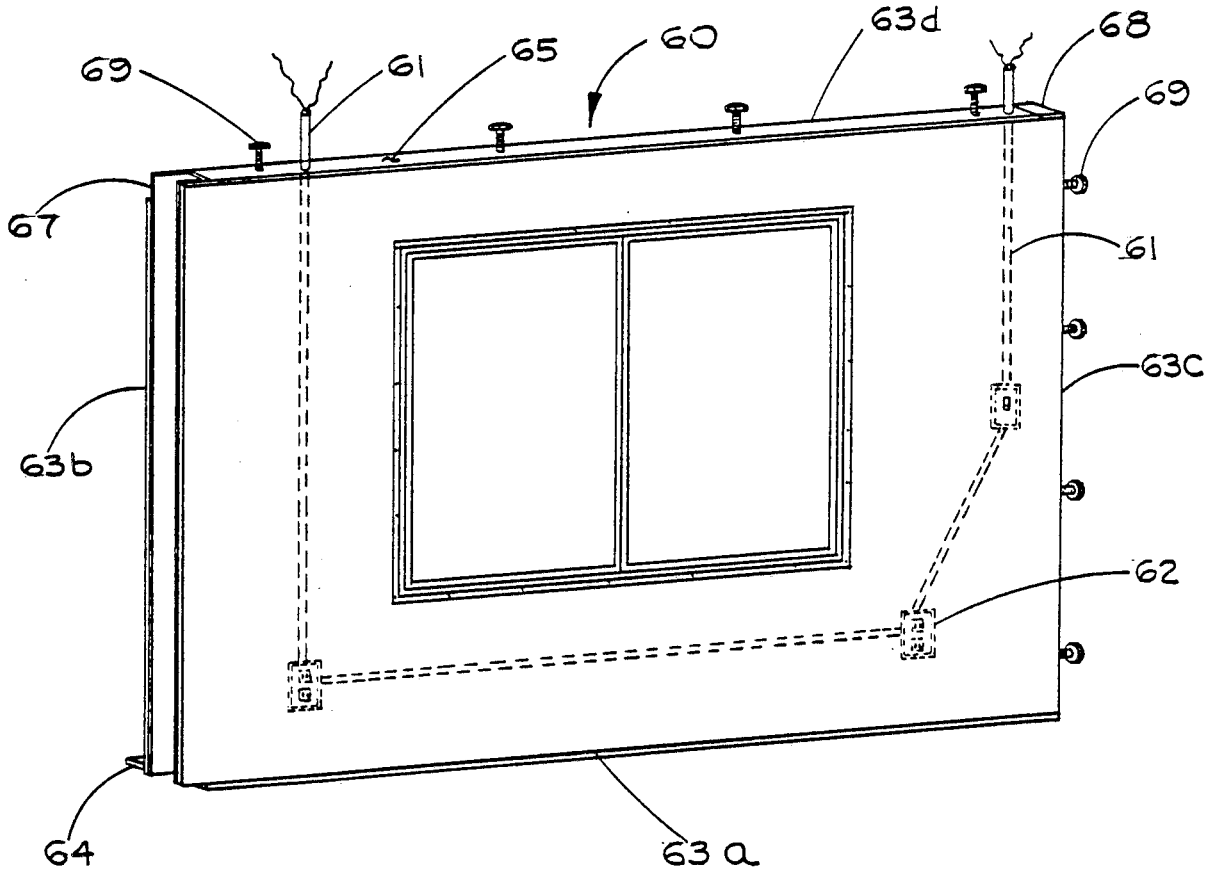
FIG. 3 is a perspective view of a typical exterior wall unit ready for field installation.

Referring now to FIG. 3, the exterior wall units (60), are pre-assembled in the factory with the windows, doors or other openings pre-engineered. The unit (60) has a height adapted to fit between the top of the basement walls (23) and the bottom of the perimeter girders (43) of the longitudinal sides and between the basement walls (23) and end angles (42) of the two end walls. The unit (60) has a length adapted to fit between two adjacent columns (31), (32), or (33) of the framework (30). Electrical conduits (61) and devices (62) are positioned and installed in the factory, all such wiring leading to the top edge of the unit and projecting therefrom. Pipes, vents and other plumbing are also installed in pre-determined positions within the appropriate exterior wall units (60), while at the factory. This is described in more detail in the explanation of the interior wall units (70)and (70*a*) below, which are also pre-assembled.

A strip of underlayment (64), is fastened to the bottom edge (63*a*) of the exterior wall unit (60) (shown in more detail in FIG. 10). One edge of the underlayment (62) is positioned flush with the outside face of the wall unit (60) and basement wall (23). The interior edge of the underlayment (64) projects past the wall unit (60) and is attached to the floor unit (50) using screws (66) or other means known in the art, once the unit (60) is in position.

Figure 11:
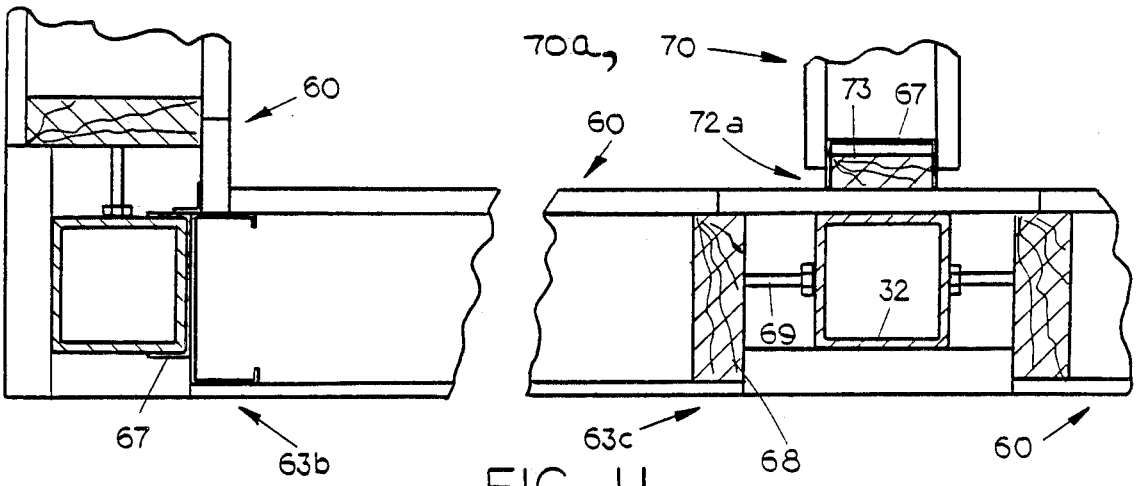
FIG. 11 is an enlarged partial sectional view showing the juncture of one end of an exterior wall unit with a corner column, and the other end of an exterior wall unit with a perimeter column, another exterior wall unit and an interior wall unit.

Referring now to FIGS. 3 and 11, one vertical edge of the exterior wall unit (60), hereinafter designated as the receiving edge (63*b*) is comprised of a channel (67). The channel (67) has its trough facing the column (31), and is dimensioned to fit snugly thereabout. The opposite vertical edge of the unit (60), hereinafter designated as the expanding edge (63*c*), is comprised of a vertically affixed stud (68) with a series of spaced-apart elongated bolts (69) tightened thereon.

To install the wall unit (60), it is first positioned between two columns (columns (31) and (32) are shown in FIG. 11), flush with the basement wall (23), then pushed such that the receiving edge (63*b*) abuts and fits around a corresponding column (31). The bolts (69) on expanding edge (63*c*) are then rotated counterclockwise, thus pressing against column (32) and restraining the wall unit (60) from movement. The bolts (69) are then tack-welded to insure no further movement or loosening.

The upper edge (63*d*) of the unit (60) is comprised of a plate (65) and spaced bolts (69) the same as the expanding edge (63*c*). These bolts (69) are also rotated counterclockwise, and then tack-welded to the girder (43) or angle (42) to further restrain movement of the wall unit (60) (as shown in FIG. 12). Succeeding exterior wall units (60) are installed in the same fashion as that described above.

Figure 4:
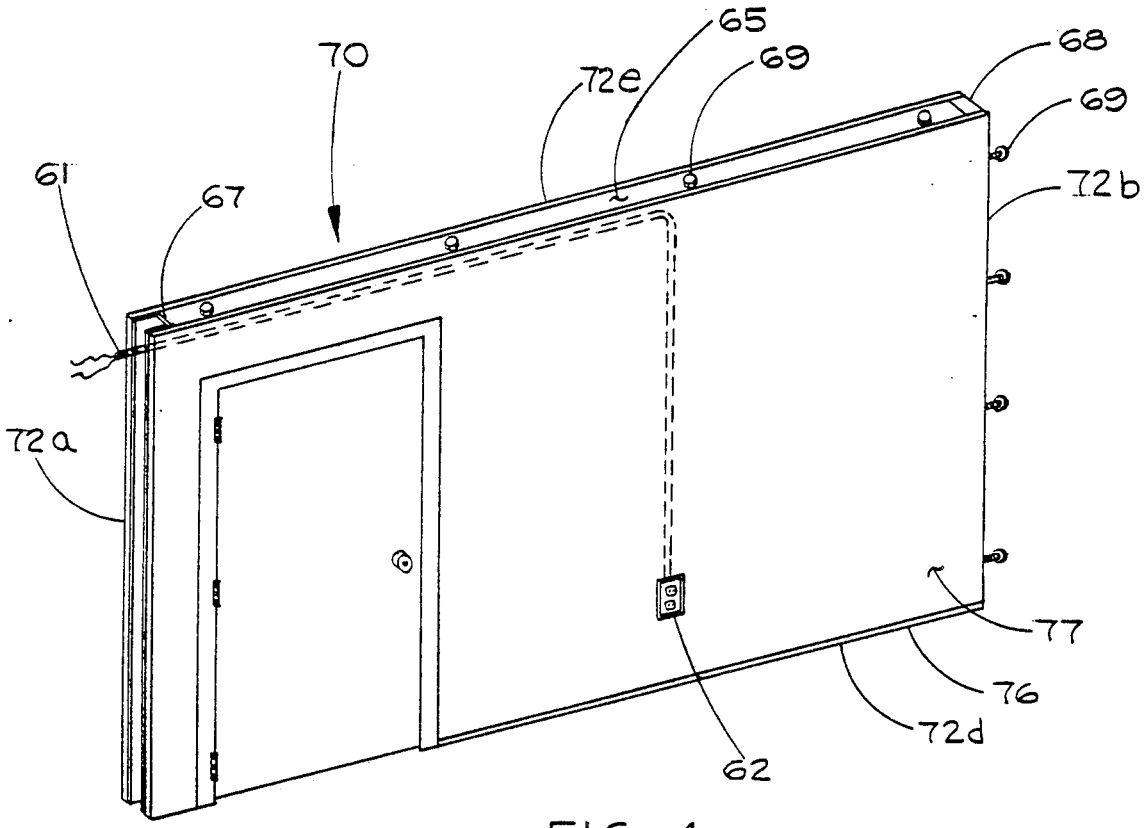
FIG. 4 is a perspective view of a typical interior wall unit ready for field installation.
Figure 4A:
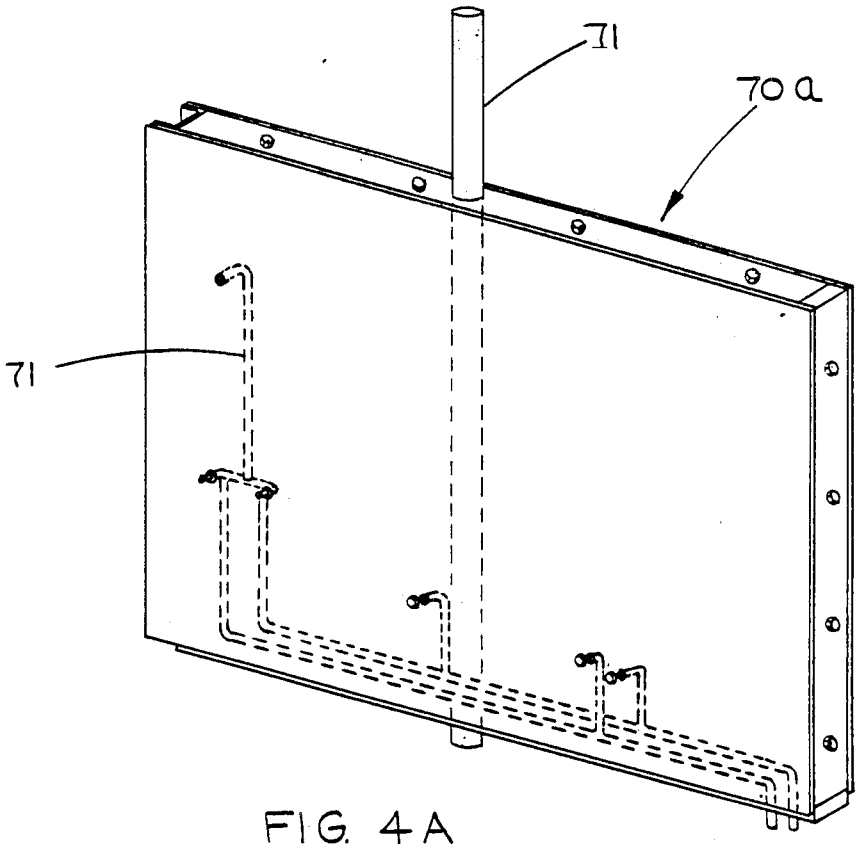

The interior wall units (70), shown in FIG. 4, are pre-assembled in the factory with the closet doors and other openings already determined and located. The unit's (70) height and length are also determined by the particular design, and are constructed appropriately at the factory. All electrical conduits (61) and other electrical devices (62) are installed in the unit (70) before shipment to the site. These conduits (61) all lead to the outer edge of the unit nearest an exterior wall (60). The interior wall unit (70*a*), shown in FIG. 4A, is a plumbing wall unit having pipes and other plumbing, designated generally at (71), installed within it. The ends of plumbing (71) project downward to corresponding plumbing in the floor unit (50), outward to the appropriate appliance and plumbing fixture in the room, or upward to the corresponding vents in a roof unit (80).

Referring back to FIG. 11, an interior wall unit (70) or (70*a*) which abuts an exterior wall (60), another wall (70), the face of a column cover plate, or the face of an interior column, has a receiving edge (72*a*) at that junction. The receiving edge (72*a*) is comprised of a channel (67) with its trough facing outwards from the interior of the wall unit (70). The channel (67) is adapted to fit against a pre-located stud (73) affixed to the abutting surface, or an interior column (33) or (34).

Referring now to FIG. 4 and 4A, an interior wall unit (70) and (70*a*), respectively, that abuts an interior column (34), has an expanding edge (72*b*) at that junction. The expanding edge (72*b*) is comprised of a vertically affixed plate (68) with elongated bolts (69), in the same fashion as the expanding edge (63*c*) of the exterior wall unit (60) as described above. Once in position, these bolts (69) are rotated counterclockwise, thereby pushing against the corresponding column (34) and restraining the unit (70) from movement.

Figure 8:
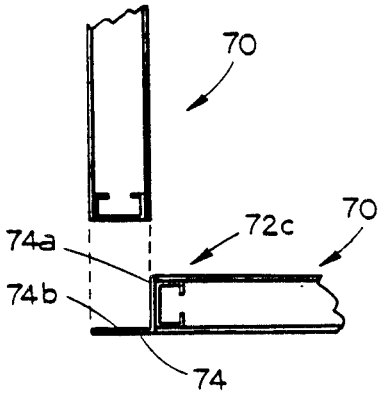
FIG. 8 is an enlarged partial sectional view showing the juncture of two interior wall units.

An interior wall unit (70) or (70*a*) which abuts an edge of another interior wall unit (70), has an abutting edge (72*c*) at that junction, as shown in FIG. 8. The abutting edge (72*c*) is comprised of an angle (74), one leg (74*a*) of which is affixed flush to the abutting edge (72*c*) the other leg (74*b*) of which projects outwardly. Once positioned, the projecting leg (74*b*) will be affixed flush against the abutting end of the other interior wall unit (70).

Figure 9:
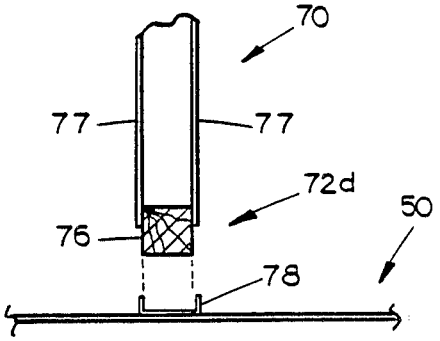
FIG. 9 is an enlarged partial sectional view showing the juncture of an interior wall unit with a floor unit.

Referring again to FIG. 4, 4A, and 9, the bottom edge (72*d*) of the wall unit (70)or (70*a*) is comprised of a horizon tally affixed member (76) which projects downwardly beyond the edge of both wall surfaces (77). The bottom edge (72*d*) is positioned within a channel (78), the channel (78) being affixed to the floor unit (50) in the appropriate location while at the factory, the trough thereof facing upwardly.

Referring once again to FIG. 4 and 4A the upper edge (72*e*) of the wall unit (70) or (70*a*) is comprised of a plate (65) with spaced bolts (69), in the same fashion as the upper edge (63*d*) of the exterior wall unit (60). These bolts (69) are not adjusted until a roof unit (80), described below, has been installed, following which the bolts (69) are rotated against the ceiling surface, holding the wall unit (70) in place.

Figure 5:
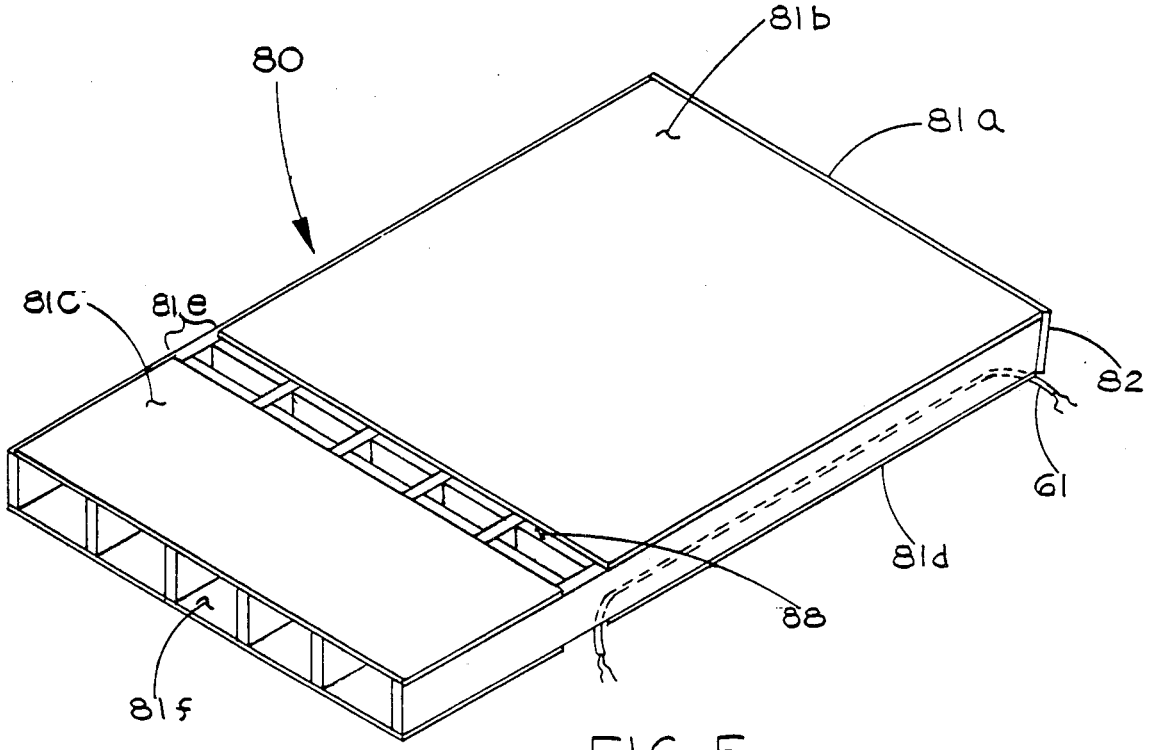
FIG. 5 is a perspective view of a typical roof unit ready for field installation.

A typical roof unit (80), shown in FIG. 5, is preassembled in a factory with all necessary openings for vents and flues, predetermined and located. All electrical conduits (61) leading to and from devices installed in the roof unit (80) (see also FIG. 12) lead to the ridge girder (44) or to the perimeter girder (43) where said conduits (61) project downwards into the channel of said girders (43) or (44). Connection of all conduits is described in more detail below.

Each roof unit (80) has a ridge edge (81*a*), an upper roof surface (81*b*), an overhanging roof surface (81*c*), a ceiling surface (81*d*), an open portion (81*e*), and a soffit surface (81*f*). The ridge edge (81*a*) of the roof unit (80), as shown in FIG. 12, is canted at an angle such that when the roof unit (80) is in position, the edge element (82) will be in a substantially vertical plane on plate (83).

The open portion (81*e*) of the roof unit (80), (seen also in FIG. 12) is located adjacent and above the longitudinal perimeter girders (43), and has perimeter edge element (88) for use in securement of roof unit (80) upon structure affixed to the top of perimeter girder (43) in a manner similar to the securement of edge (81*a*) to ridge girder (44).

Therefore, the roof units (80) are installed in the following manner. First, a roof unit, (80), pre-assembled with a pre-engineered overhang, is located on one lateral end of the building. The unit (80) is then clamped in place. After all roof units are in place on both sides of the ridge, clamping at ridge edge (81*a*) is completed. Clamping at the open edge (81*e*) is done as described above as each unit is placed.

The preferred embodiment does not include a description of a ceiling other than the finished underside of roof units (80), thereby effecting a "cathedral" type ceiling throughout the building. Were a level ceiling desired, angles having inwardly projecting horizontal members would be affixed parallel to the longitudinal walls between sets of adjacent lateral columns (33) and interior columns (34) and opposing sets of end columns (31) and perimeter longitudinal columns (32) at the desired ceiling height.

Once all of the floor (50), exterior wall (60), interior wall (70) and (70*a*) and roof units (80) are in place, proper finishing of the building may be effected as well known in the art.

Electrical conduits (61), as shown in FIGS. 3, 4, and 12 are tied into the appropriate circuits of wiring contained in main conduits (91) which run within the channel of the ridge girders (44) and perimeter girders (43) (as shown in FIG. 12). The main conduits (91) are connected to the source of power via risers located within the hollow of columns (32), walls (60) or (70), or wherever convenient. Since all wiring is already in place, the high cost of skilled labor in connecting the wires and circuits to the source is drastically reduced.

Plumbing connections between floor (50) and wall units (60), (70), and (70*a*) are quickly and easily made, and plumbing fixtures installed where necessary. The only on-site plumbing requiring skilled labor is in connecting the pipes to the source, and the connections described above.

The majority of the heating, venting and air conditioning ductwork is installed at the factory, leaving only the connections between the ducts projecting to the central axis of the basement from each floor unit (50), and the source, to be completed at the site.

The building may then be finished in a manner well known in the art, all openings for connections being covered and insulated by filler materials.

It will be readily understood that the particular disposition or arrangement or nature of the elements of the invention are not of the essence of the invention, and that many variations, substitutions, and modifications may be made, in departure from the particular construction and characterization in the drawings and foregoing description, without departing from the true spirit of the invention. It is therefore to be understood that the invention should be limited only by the breadth and scope of the appended claims.

I claim:

1. A pre-engineered building of the type having substantially all structural members, wall units, floor units, and roof units, including substantially all windows, door openings and mechanical appurtenances therein, completed simultaneously at the factory for coordinated installation at jobsite, the improvement comprising:

two rows of ground supported perimeter column footings substantially equally spaced along opposing walls of a building with perimeter wall footings connecting the column footings, located within an excavated basement area or at ground level;

columns affixed to each column footing of a height terminating one story or higher above first floor level and rigid support means connecting the columns at each floor level and tops to form a grid pattern;

a poured concrete basement wall supported atop said perimeter wall footing, having a two-level upper end, the lower level being proximal the inside of the building;

one or more floor units, supported at each end atop the lower levels of the tops of opposing basement walls;

one or more roof units supported at each end atop opposing rigid support means;

means for clamping each end of said roof to said rigid support means therealong; and one or more non-load bearing wall units having means for receiving a column affixed along one of its edges and means for expanding against the next adjacent column along its opposing edge, whereby said wall units may be secured between said columns.

2. The pre-engineered building of claim 1, further comprising:

an additional row of column footings which is located between said rows of perimeter column footings, said additional row including a lateral perimeter column footing on each end and interior column footings therebetween, all column footings to be in a grid pattern;

columns affixed to each of said additional column footings of a height terminating a sufficient distance above said perimeter columns to provide a slope roof;

additional rigid support means for connecting said additional column at each floor level and tops into the grid pattern, whereby said additional rigid support means connecting additional column tops serve as ridge girders;

means connecting adjacent additional columns on either side thereof for forming a ledge, at a height equal to the lower level of the top of said basement wall, for supporting one end of each floor unit; and additional floor units, roof units, roof unit clamping means, and wall units as needed.

3. The pre-engineered building of claim 1 wherein said non-load bearing wall units are further characterized as having means affixed along their top edges for expanding against the rigid support means connecting the two surrounding columns.

4. The pre-engineered building of claim 3, further comprising an inwardly projecting underlayment affixed to the bottom of said wall units and means for fastening said underlayment to said floor unit.

5. The pre-engineered building of claim 2 wherein the additional column ledge forming means includes an angle having one leg horizontal to serve as the ledge and further comprising a plurality of pivot clamps adjustably bolted along the bottom of the end of said floor unit which rests upon the ledge, whereby said clamps can be pivoted under the ledge and then tightened to secure said floor unit to the ledge.

6. The pre-engineered building of claim 1, wherein the roof clamping means is characterized as including a plurality of spaced threaded sleeves affixed along a centered line atop said rigid support means, an elongated rigid strap having an aperture for each of said sleeves which is coaxial therewith and a bolt cooperatively threaded with each of said sleeves, said bolts being positioned through said strap and tightly engaging an end of said roof unit atop said rigid support means.

7. The pre-engineered building of claim 2, wherein said roof unit clamping means is characterized as including an elongated perimeter plate affixed atop the rigid support means which connects perimeter columns, at an angle parallel to the slope of the roof units; a plurality of spaced apart threaded perimeter sleeves affixed atop said perimeter plate; an elongated rigid perimeter strap having an aperture for each of said perimeter sleeves which is coaxial therewith and a bolt cooperatively threaded with each of said sleeves, said bolts being positioned through said perimeter strap and tightly engaging the perimeter end of said roof unit atop said perimeter rigid support means; a canted at an angle ridge edge element, affixed along the ridge end of said roof unit, having an exposed surface which is vertical; a plurality of spaced apart threaded aligned ridge sleeves affixed atop said rigid support means which serves as a ridge girder; an elongated rigid ridge strap having an aperture for each of said ridge sleeves which is coaxial therewith; a bolt threaded to cooperate with each of said ridge sleeves, said bolts being positioned through said perimeter strap and engaging the tops of opposing roof units which rest on either side of said ridge girder.

8. The pre-engineered building of claim 7, wherein said roof unit is further characterized as extending beyond said perimeter plate to form an overhang and said clamping means is located within a temporary open space with said overhang adjacent to said perimeter plate.

9. The pre-engineered building of claim 1, further comprising one or more interior wall units which include an elongated means affixed to the upper surface of a floor unit for receiving the bottom edge of said interior wall unit; and means affixed along the upper edge of said interior wall unit for expanding against the underside of the roof or ceiling unit located overhead.

10. The pre-engineered building of claim 9, wherein said interior wall units are further characterized as having channel for receiving a stud affixed along one of its edges and means for affixing against the edge of another interior wall unit on its opposing edge comprising an angle with one leg affixed flush to said edge, the other leg projects outward to be affixed flush against the abutting end of other interior wall unit.

11. The pre-engineered building of claim 1 further comprising:

special reusable concrete forms for slab or basement wall characterized by having factory coordinated attach points thereon to attach to perimeter columns with no measuring, leveling, bracing and plumbing required;

one or more independent building units may be quickly and easily removed and replaced in framework if damaged or if building is to be disassembled;

interior plumbing wall unit completed in the factory having all essential piping and connections sized and assembled therein having pre-determined locations with provisions for utility entrance, plumbing fixtures and roof vent;

electrical conduits and devices located and designated into each independent building unit by the overall electrical plan of building with wires leading to outer perimeter of building whereby a space is provided for connecting to circuit wiring.

* * * * *